US010428702B2

(12) United States Patent
Altherr et al.

(10) Patent No.: US 10,428,702 B2
(45) **Date of Patent: *Oct. 1, 2019**

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Markus Walch, Bretten (DE); Thorsten Ihne, Stuttgart (DE)

(73) Assignee: Mahle International GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,383

(22) Filed: Mar. 26, 2018

(65) Prior Publication Data

US 2018/0274404 A1 Sep. 27, 2018

(30) Foreign Application Priority Data

Mar. 27, 2017 (DE) ..... 10 2017 205 151

(51) Int. Cl.
*F01L 13/00* (2006.01)
*F01L 1/047* (2006.01)
(Continued)

(52) U.S. Cl.
CPC ..... *F01L 13/0005* (2013.01); *F01L 1/047* (2013.01); *F01L 1/053* (2013.01); *F01L 1/181* (2013.01);
(Continued)

(58) Field of Classification Search
CPC ... F01L 1/047; F01L 1/053; F01L 1/08; F01L 1/46; F01L 13/0005; F01L 13/0036
(Continued)

(56) References Cited

U.S. PATENT DOCUMENTS 7,066,145 B2 6/2006 Hashizume et al.
7,493,878 B2 2/2009 Schon et al.
(Continued)

FOREIGN PATENT DOCUMENTS

DE 30 06 619 A1 8/1981
DE 19945340 A1 3/2001
(Continued)

OTHER PUBLICATIONS

English abstract for DE202015009047.
(Continued)

*Primary Examiner* — Jorge L Leon, Jr.
(74) *Attorney, Agent, or Firm* — Fishman Stewart PLLC

(57) ABSTRACT

A valve drive for an internal combustion engine may include a camshaft, at least one cam follower, at least one adjusting device, and at least one control shaft. The camshaft may include at least one cam group including a first cam and a second cam. The at least one adjusting device may include a first engagement element and a second engagement element. The at least one control shaft may include at least one control cam group including a first control cam and a second control cam. The at least one control shaft may rotate such that at least one stop region of the first control cam adjusts the first engagement element from the basic position into the switching position and at least one stop region of the second control cam adjusts the second engagement element from the basic position into the switching position one after the other.

20 Claims, 3 Drawing Sheets

(51) Int. Cl.

| | |
|---|---|
| ***F01L 1/22*** | (2006.01) |
| ***F01L 1/053*** | (2006.01) |
| ***F01L 1/18*** | (2006.01) |
| ***F01L 13/06*** | (2006.01) |
| *F01L 1/02* | (2006.01) |
| *F01L 1/26* | (2006.01) |
| *F01L 1/38* | (2006.01) |

(52) U.S. Cl.
CPC ..... *F01L 1/22* (2013.01); *F01L 13/06* (2013.01); *F01L 1/024* (2013.01); *F01L 1/026* (2013.01); *F01L 1/267* (2013.01); *F01L 1/38* (2013.01); *F01L 13/0036* (2013.01); *F01L 2013/001* (2013.01); *F01L 2013/103* (2013.01); *F01L 2105/00* (2013.01)

(58) Field of Classification Search
USPC ..... 123/90.16, 90.17, 90.21, 90.27
See application file for complete search history.

(56) References Cited

U.S. PATENT DOCUMENTS

| | | | | |
|---|---|---|---|---|
| 2009/0194048 | A1 | 8/2009 | Schoen et al. | |
| 2010/0139594 | A1* | 6/2010 | Wutzler | F01L 13/0036 123/90.17 |
| 2011/0315103 | A1* | 12/2011 | Kim | F01L 1/053 123/90.16 |
| 2017/0198613 | A1* | 7/2017 | Raimondi | F01L 1/185 |
| 2017/0284238 | A1* | 10/2017 | Son | F01L 1/047 |
| 2017/0284314 | A1* | 10/2017 | Son | F01L 1/053 |

FOREIGN PATENT DOCUMENTS

| | | | |
|---|---|---|---|
| DE | 10 2004 040 537 | A1 | 4/2005 |
| DE | 102004033963 | A1 | 2/2006 |
| DE | 10 2005 010 484 | B3 | 10/2006 |
| DE | 10 2005 021 114 | A1 | 11/2006 |
| DE | 10312961 | C5 | 1/2009 |
| DE | 10 2007 037 332 | A1 | 2/2009 |
| DE | 202015009047 | U1 | 8/2016 |
| EP | 0 179 990 | A2 | 5/1986 |
| WO | 2015180 896 | A1 | 12/2015 |

OTHER PUBLICATIONS

English abstract for DE-199 45 340.
English abstract for DE-10 2005 021 114.
Engilsh abstract for DE-102004033963.
English abstract for DE-10 2007 037 332.
English abstract for DE-30 06 619.

* cited by examiner

VALVE DRIVE FOR AN INTERNAL COMBUSTION ENGINE

CROSS-REFERENCE TO RELATED APPLICATIONS

This application claims priority to German Patent Application No. DE 10 2017 205 151.5, filed on Mar. 27, 2017, the contents of which are hereby incorporated by reference in its entirety.

TECHNICAL FIELD

The present invention relates to a valve drive for an internal combustion engine with a camshaft and with a cam follower.

BACKGROUND

Generic valve drives for an internal combustion engine with a camshaft and with at least one cam follower and with a cam group non-rotatably fixed on the camshaft with a first cam and with a second cam axially adjacent to the first cam are already known. There, the cam follower is drive-connected in a first position with the first cam of the respective cam group and in a second position with the second cam of the respective cam group.

By way of an adjusting device, the cam follower can be switched between the first position and the second position and thus activate or deactivate a corresponding cylinder of the internal combustion engine. In order to control the adjusting device, the valve drive known from the prior art comprises a control shaft which is rotatably and axially moveably mounted and controls the adjusting device by way of a control element group fixed on the control shaft.

Disadvantageous with the control shaft known from the prior art however is that activating the adjusting device is only possible by a complex movement sequence—for example a rotation combined with an axial shift. This not only results in longer activation times but also increases the production and repair costs. Furthermore, a separate activation of the individual cylinders cannot be realised or only with major effort.

SUMMARY

The object of the invention therefore is to state for a valve drive of the generic type an alternative embodiment in which the activation of the individual cylinders is realised through a simplified movement sequence and a separate activation of the individual cylinders with a reduced effort is possible.

According to the invention, this object is solved through the subject of the independent claim(s). Advantageous embodiments are subject of the dependent claim(s).

The present invention is based on the general idea of stating a control shaft of a valve drive, with which the activation of the individual cylinders is realised through a simplified movement sequence for the first time. To this end, the valve drive comprises a camshaft and at least one cam follower, wherein the camshaft comprises at least one cam group that is non-rotatably fixed on the camshaft with a first cam and with a second cam that is axially adjacent to the first cam. In a first position, the respective cam follower is drive-connected with the first cam of the respective cam group and in a second position with the second cam of the respective cam group. For adjusting the cam follower in the first position or in the second position, the valve drive comprises at least one adjusting device which comprises a first adjustable engagement element and a second adjustable engagement element. Here, the first engagement element interacts with a first guide arranged in the camshaft and the second engagement element interacts with a second guide arranged on the camshaft. The first engagement element and the second engagement element are alternately adjustable between a basic position and a switching position, wherein in the basic position there is no contact with the associated guide and in the switching position the respective engagement element interacts with the associated guide. The valve drive also comprises at least one control shaft with at least one control cam group, wherein the control cam group comprises a first control cam arranged on the control shaft and a second control cam arranged on the control shaft.

According to the invention, the control shaft is rotatably mounted about a longitudinal axis and the first control cam comprises at least one idle region and at least one stop region for the respective first engagement element and the second control cam comprises at least one idle region and at least one stop region for the respective second engagement element. Upon rotation of the control shaft, the first control cam can adjust the first engagement element by way of the stop region from the basic position into the switching position and the second control cam can adjust the second engagement element by way of the stop region from the basic position into the switching position. In the respective idle region, the first engagement element has no contact with the first control cam and the second engagement element has no contact with the second control cam.

The first control cam and the second control cam are arranged on the control shaft so that an alternating actuation of the first engagement element and of the second engagement element is possible. Thus, when the first engagement element upon rotation of the control shaft is transferred from the basic position into the switching position by way of the stop region of the first control cam and the first engagement element has been adjusted, the second control cam with the idle region lies against the second engagement element and, upon rotation of the control shaft, can adjust the second engagement element from the basic position into the switching position by way of the stop region of the second control cam.

With the valve drive according to the invention an activation of corresponding cylinders is now realised merely by a rotation of the control shaft so that no complex movement sequence is necessary and the activation times and the production and the repair costs can be reduced.

Advantageously it is provided that the control shaft is rotatably mounted into an activation direction and in a deactivation direction that is opposite to the activation direction, wherein upon rotation of the control shaft in the activation direction the first engagement element is adjusted by the first control cam and upon the rotation of the control shaft into the deactivation direction the second engagement element can be adjusted by the second control cam from the basic position into the switching position. Accordingly, the control shaft can first be rotated in the activation direction and the corresponding first engagement element adjusted and because of this the corresponding cylinder activated. Following this, the control shaft can be rotated into a defined starting position. When the cylinder is now deactivated, the control shaft can be rotated into the deactivation direction and the second engagement element actuated by the second control cam.

In a further development of the solution according to the invention it is advantageously provided that the valve drive comprises a control shaft with multiple control cam groups, wherein by way of the respective control cam group the corresponding adjusting device with the corresponding cam follower can be actuated and thus a corresponding cylinder be activated or deactivated.

When for example a first cylinder is activated, the first control cam in a first control cam group actuates the corresponding adjusting device and the first control cams of the other control cam groups run through at the corresponding adjusting devices with the idle regions. When the second cylinder is now activated in addition to the first cylinder, the first control cam actuates the corresponding adjusting device in a second control cam group. The first control cams of the remaining control cam groups and the second control cam of the first control cam group run through at the corresponding adjusting devices with the idle regions. Thus, the cylinder activated by the first control cam group remains activated and the cylinder activated by the second control cam group is activated.

The control shaft with the individual control cam groups can be configured so that upon a full revolution of the control shaft in the activation direction, all cylinders are activated and upon a full revolution of the control shaft in the deactivation direction, all cylinders are deactivated. Advantageously, the individual cylinders can also be activated or deactivated one after the other, individually or even in pairs. Advantageously, multiple cylinders can be activated or deactivated with a single control shaft by way of a valve drive configured in such a manner so that a simple construction of the valve drive is possible and consequently the production costs and the repair costs can be reduced. In addition, the activation times of the individual cylinders can be shortened and any switching sequence for the individual cylinders realised.

In an alternative further development of the solution according to the invention it is advantageously provided that the valve drive comprises at least two control shafts with at least one control cam group, wherein by way of the respective control cam group the corresponding adjusting device with the corresponding cam follower can be actuated and thus a corresponding cylinder activated or deactivated.

Accordingly, the for example first control shaft can activate a first cylinder group and the second control shaft a second cylinder group. The first and the second cylinder group can differ in the number of cylinders. It is also provided that the individual cylinders each comprise a control shaft in order to be able to perform the activation of the valve drive in a particularly quick manner.

Advantageously it is provided in a further development of the valve drive that the control shaft comprises an inner shaft and an outer shaft encasing the inner shaft, wherein the inner shaft and the outer shaft are rotatable relative to one another. The respective first control cams are fixed on the inner shaft or on the outer shaft and the respective second control cams are correspondingly fixed on the outer shaft or on the inner shaft.

Thus, upon rotation of the outer shaft in the activation direction, the individual cylinders can be activated by way of the respective first control cams fixed on the outer shaft and upon rotation of the inner shaft in the deactivation direction, the individual cylinders be deactivated by way of the respective second control cams fixed on the inner shaft. In this embodiment of the valve drive, the rotation of the first control cams in the activation direction is only performed by the inner shaft or by the outer shaft and the rotation of the second control cams only by the outer shaft or by the inner shaft. An alternative configuration, in which the first control cams are fixed on the inner shaft and the second control cams on the outer shaft can likewise be realised.

Advantageously it is provided that the stop region of the first control cam and/or of the second control cam extends from the longitudinal axis of the control shaft radially to the outside. By way of such a simple design, the control cams and thus the control shaft can be produced in a mechanically sturdy and cost-effective manner.

The respective stop region in this case can be arranged on a circumferential region of the respective control cam, wherein the circumferential region axially encases the control shaft in regions and makes possible fixing the control cam on the control shaft—for example by way of a connecting pin. The idle region is then provided by a radial recess which is moulded into a radial plane between the stop region and the circumferential region.

Advantageously, the stop region can have an opening angle between 0° and 270°, preferentially between 30° and 180° relative to the longitudinal axis of the control shaft. Here, the opening angle is defined by lateral faces of the stop region extending radially from the longitudinal axis. The stop regions of the individual control cams can have opening angles that are distinct from one another to achieve an optimal activation behaviour and an optimal deactivation behaviour of the individual cylinders.

In an advantageous further development of the valve drive according to the invention it is provided that the stop regions of the first control cams and the stop regions of the second control cams are fixed on the control shaft rotated by an arrangement angle relative to one another. The arrangement angle between the first control cams is defined as an angle between the lateral faces of the respective stop regions turned into the activation direction of the control shaft. Between the second control cams the arrangement angle is defined as an angle between the lateral faces of the respective stop regions turned into the deactivation direction of the control shaft.

By way of varying arrangement angles it can be achieved that depending on the angle of rotation of the control shaft in the activation direction or in the deactivation direction the adjusting devices and the cam followers can be actuated one after the other, individually or even in pairs and thus the individual cylinders be activated or deactivated one after the other, individually or even in pairs.

Advantageously it is provided that the stop region of the first control cam and/or of the second control cam comprises a ramp region which can steadily grow from a neutral region to the stop region. By way of the ramp region, the mechanical load on the respective engagement elements can be reduced and a secure changeover between the basic position and the switching position of the engagement elements additionally achieved.

In order to make possible a step-by-step rotation of the control shaft, the valve drive can comprise a control shaft drive. The control shaft drive can be for example a toothed belt drive or a gearwheel drive or a stepping motor drive. By way of the control shaft drive, the control shaft can perform individual discrete rotations about a defined angle of rotation in the activation direction or in the deactivation direction so that by way of the control shaft with multiple control cam groups, multiple cylinders can be activated or deactivated one after the other, individually or in pairs.

In an advantageous further development of the valve drive it is provided that the control shaft comprises a resetting arrangement by way of which the control shaft can be brought into a defined starting position. The resetting arrangement resets the control shaft into the defined starting position so that undesirable rotation of the control shaft is avoided. The resetting arrangement can be realised for example by a spring resetting with a torsion spring, a coil spring or a bending spring. In the starting position of the control shaft, the corresponding cylinders are set to the basic valve stroke and the control shaft lies against the first engagement element to be actuatable with the first control cam.

Advantageously it is provided that the second control cam is a zero stroke cam, by way of which deactivation of the corresponding cylinder can be realised. Alternatively it is provided that the second control cam is a braking cam, by way of which an exhaust brake can be realised. A two-stroke exhaust brake can also be realised by the second control cam in the form of a braking cam with two stop regions.

In a further development of the solution according to the invention it is also provided that the stop region of the first control cam and the stop region of the second control cam each are a profiled recess in the control shaft. The profiled recesses can each interact for example with an elevation of the first engagement element and of the second engagement element, so that by rotating the control shaft the first engagement element and the second engagement element and the corresponding adjusting device can be actuated by the profiled recesses of the respective control cams.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1:
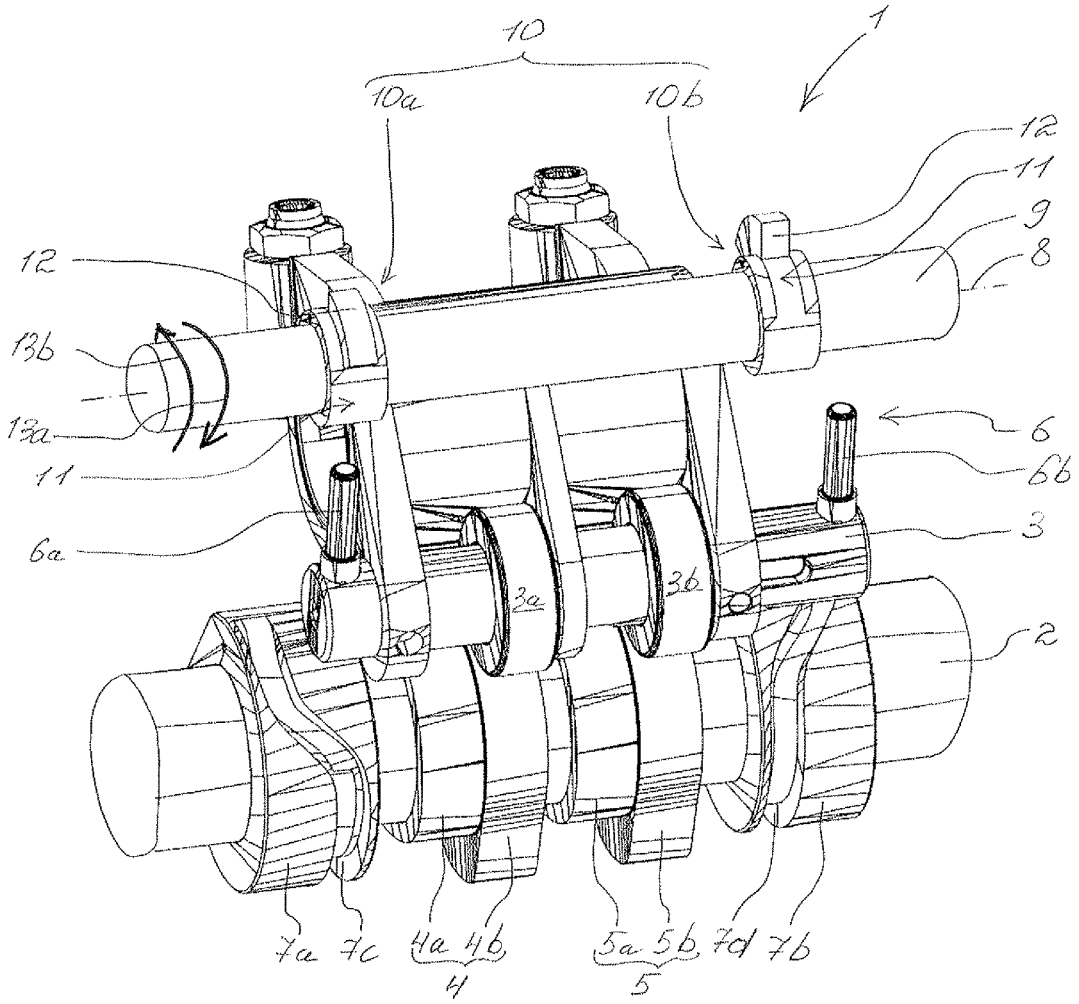
FIG. 1 a part view of a valve drive according to the invention with a control shaft.

FIG. 1 shows a part view of a valve drive 1 of an internal combustion engine which is not shown in more detail. The valve drive 1 comprises a camshaft 2 and a cam follower 3. The camshaft 2 comprises a first cam group 4 with a first cam 4*a* and with a second cam 4*b* as well as a second cam group 5 with a first cam 5*a* and a second cam 5*b*. The first cam group 4 and the second cam group 5 are non-rotatably fixed on the camshaft 2. By way of the first cam group 4 and the second cam group 5 a cylinder which is not shown in more detail can be activated, in that for example the first cam group 4 activates an inlet valve of the cylinder and the second cam group 5 an exhaust valve of the cylinder.

The cam follower 3 is drive-connected to the first cam group 4 via a first roller 3*a* and to the second cam group 5 via a second roller 3*b*. In a first position, the rollers 3*a* and 3*b* interact with the first cams 4*a* and 5*a* of the respective cam group 4 and 5 and in a second position the rollers 3*a* and 3*b* interact with the second cams 4*b* and 5*b* of the respective cam groups 4 and 5.

For adjusting the cam follower 3 into the first position or into the second position, the valve drive 1 comprises an adjusting device 6 which comprises a first adjustable engagement element 6*a* and a second adjustable engagement element 6*b*. Here, the first engagement element 6*a* interacts with a first guide 7*c* of a first slotted guide 7*a* fixed on the camshaft 2 and the second engagement element 6*b* interacts with a second guide 7*d* of a second slotted guide 7*b* fixed on the camshaft 2. The first engagement element 6*a* and the second engagement element 6*b* are alternately adjustable between a basic position and a switching position, wherein in the basic position there is not contact with the associated slotted guide 7*a* or 7*b* and in the switching position the respective engagement element 6*a* or 6*b* interacts with the associated slotted guide 7*a* or 7*b*.

The valve drive 1 also comprises at least one control shaft 9 that is rotatably mounted about a longitudinal axis 8 with a control cam group 10, wherein the control cam group 10 comprises a first control cam 10*a* fixed on the control shaft 9 and a second control cam 10*b* fixed on the control shaft 9. According to the invention, the first control cam 10*a* comprises an idle region 11 and a stop region 12 for the first engagement element 6*a* and the second control cam 10*b* comprises the idle region 11 and the stop region 12 for the second engagement element 6*b*. When the control shaft 9 is rotated, the first control cam 10*a* can adjust the first engagement element 6*a* by way of the stop region 12 from the basic position into the switching position and the second control cam 10*b* can adjust the second engagement element 6*b* by way of the stop region 12 from the basic position into the switching position (see also FIG. 2-4). In the respective idle region 11, the first engagement element 6*a* has no contact with the first control cam 10*a* and the second engagement element 6*b* has no contact with the second control cam 10*b*.

The first control cam 10*a* and the second control cam 10*b* are arranged on the control shaft 9 so that an alternating actuation of the first engagement element 6*a* and the second engagement element 6*b* is possible. Thus, when during the rotation of the camshaft 9 in an activation direction 13*a* the first engagement element 6*a* has been transferred from the basic position into the switching position by way of the stop region 12 of the first control cam 10*a* and the cam follower 3 has been adjusted, the second control cam 10*b* lies against the second engagement element 6*b* with the idle region 11. The second engagement element 6*b* is in the basic position. When the control shaft 9 is rotated into a deactivation direction 13*b* that is opposite to the activation direction 13*a*, the second engagement element 6*b* is now adjusted from the basic position into the switching position by way of the stop region 12 of the second control cam 10*b*.

With the valve drive 1 according to the invention, an activation of corresponding cylinders is realised only by a rotation of the control shaft 9 into the activation direction 13*a* or in the deactivation direction 13*b* so that no complex movement sequence is necessary and the activation times as well as the production and repair costs can be reduced.

Figure 2:
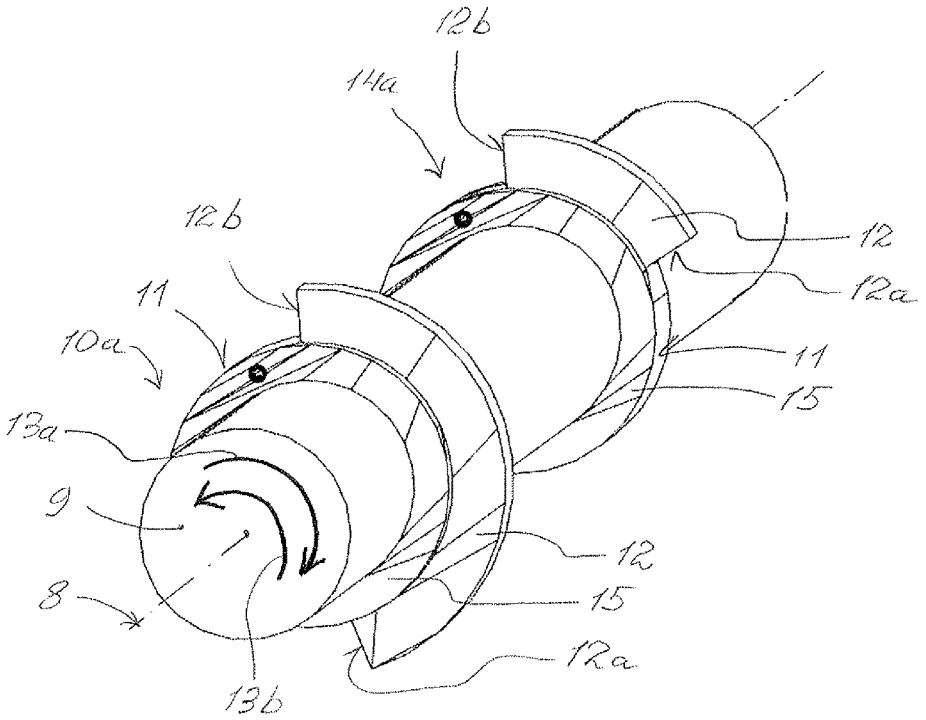
FIG. 2 a view of a first control cam of a first control cam group and of a first control cam of a second control cam group.
Figure 3:
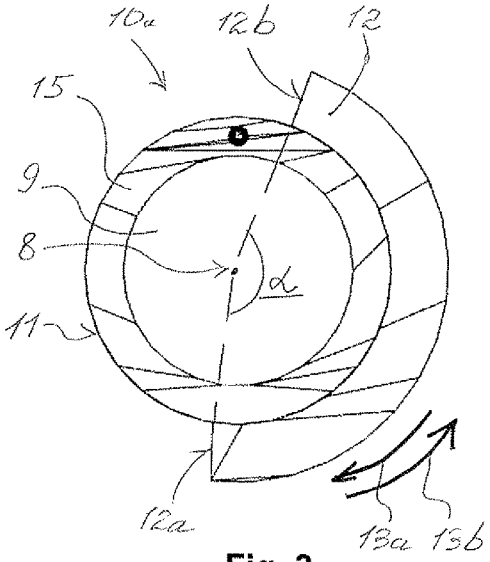
FIG. 3 a front view of the first control cam of the first control cam group shown in FIG. 2.
Figure 4:
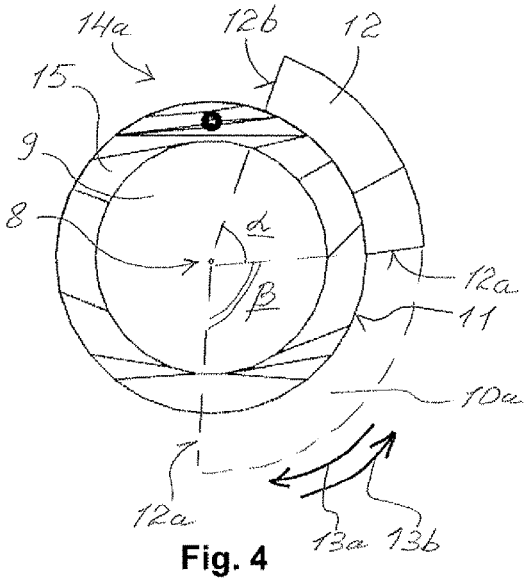
FIG. 4 a front view of the first control cam of the second control cam group shown in FIG. 2.

FIG. 2 shows the first control cam 10*a* of the first control cam group 10 and of a first control cam 14*a* of a second control cam group 14. In FIG. 3 and in FIG. 4, front views of the first control cams 10*a* and 14*a* shown in FIG. 2 are shown. The stop region 12 of the first control cam 10*a* and of the second control cam 14*a* extends from the longitudinal axis 8 of the control shaft 9 radially to the outside. The respective stop regions 12 are each arranged on a circumferential region 15 of the respective control cam 10*a* and 14*a*, wherein the circumferential region 15 axially embraces the control shaft 9 in regions and radially fixes the respective control cam 10*a* and 14*a* on the control shaft 9. Axially fixing the respective control cams 10*a* and 10*b* can be effected for example by a connecting pin. The respective idle region 11 is provided by a radial recess which is moulded into a radial plane between the stop region 12 and the circumferential region 15.

The stop region 12 has an opening angle α relative to the longitudinal axis of the control shaft 9, which is between 0° and 270°, preferentially between 30° and 180°. Here the opening angle α is defined by lateral faces 12*a* and 12*b* of the stop region 12 extending radially to the longitudinal axis 8.

The stop regions 12 of the first control cams 10*a* and 14*a* are fixed rotated relative to one another by an arrangement angle β on the control shaft 9. The arrangement angle β is defined as an angle between the lateral faces 12*a* of the respective stop regions 12 turned in the activation direction 13*a* of the control shaft 9. The opening angles α of the control cams 10*a* and 14*a* differ from one another and the first control cams 10*a* and 14*a* are turned relative to one another by the arrangement angle β in order to achieve an activation of the corresponding cylinders, for example one after the other or individually.

In the case of multiple cylinders to be activated, it can be achieved by adapting the arrangement angle β and the opening angle α that depending on the angle of rotation of the control shaft 9 in the activation direction 13*a* or in the deactivation direction 13*b* the individual cylinders can be activated or deactivated one after the other, individually or even in pairs.

Figure 5:
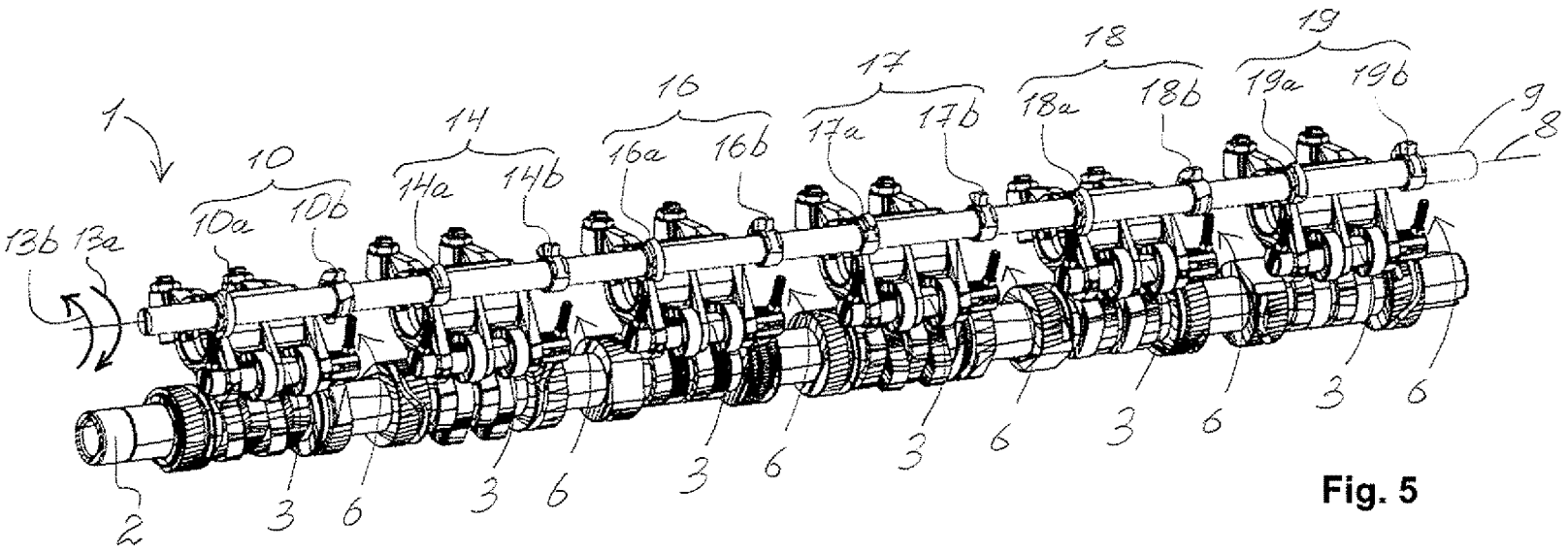
FIG. 5 a view of a valve drive with a control shaft and with six control cam groups.
Figure 6:
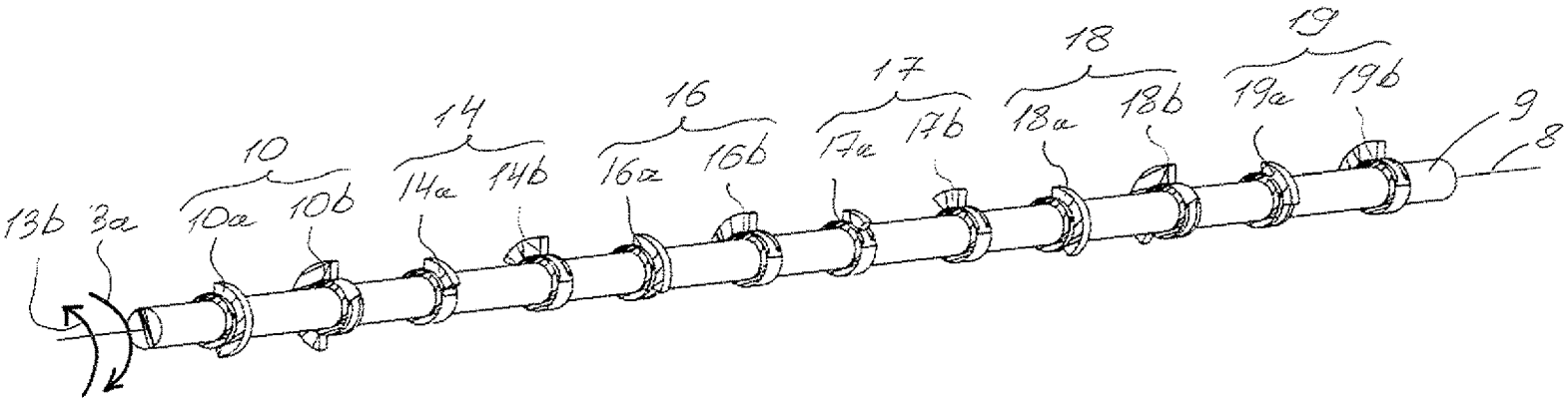
FIG. 6 a view of the control shaft of the valve drive shown in FIG. 5.

FIG. 5 shows a view of the valve drive 1 with the control shaft 9 and with a total of six control cam groups 10, 14, 16, 17, 18 and 19. In FIG. 6, a view of the control shaft 9 shown in FIG. 5 is shown. By way of the respective control cam group 10, 14, 16, 17, 18 and 19, the corresponding adjusting devices 6 are actuated with the corresponding cam follower 3 and thus a corresponding cylinder activated or deactivated.

When for example a first cylinder is activated, the first control cam 10*a* in a first control cam group 10 actuates the corresponding adjustment device 6 and the first control cams 14*a*, 16*a*, 17*a*, 18*a* and 19*a* of the control cam groups 14, 16, 17, 18 and 19 run through the associated adjusting devices 6 with the idle regions. When the second cylinder is now activated in addition to the first cylinder, the first control cam 14*a* in the second control cam group 14 actuates the corresponding adjusting device 6. The first control cams 16*a*, 17*a*, 18*a* and 19*a* of the control cam groups 16, 17, 18 and 19 as well as the second control cam 10*b* of the first control cam group 10 run through on the corresponding adjusting devices 6 with the idle regions 11. Accordingly, the cylinder activated by the first control cam group 10*a* remains activated and the cylinder activated by the second control group 14 is activated in addition.

The control shaft 9 with the control cam groups 10, 14, 16, 17, 18 and 19 is configured in such a manner that upon a full rotation of the control shaft 9 in the activation direction 13*a* all cylinders are switched and upon a full revolution of the control shaft 9 in the deactivation direction 13*b*, all cylinders are deactivated. Advantageously, the individual cylinders can be activated or deactivated one after the other, individually or even in pairs.

A step-by-step rotation of the control shaft 9 can be carried out by a control shaft drive—for example a toothed belt drive or a gearwheel drive or a stepping motor drive. The control shaft drive can also comprise multiple drives which are arranged laterally or in the middle of the control shaft. In order to avoid an undesirable adjustment of the control shaft 9 the control shaft 9 can comprise a resetting arrangement—for example a spring resetting arrangement.

The invention claimed is:

1. A valve drive for an internal combustion engine, the valve drive comprising:

a camshaft including at least one cam group non-rotatably fixed on the camshaft, the at least one cam group including a first cam and a second cam axially adjacent to the first cam;

at least one cam follower drive-connected to the first cam when in a first position and to the second cam when in a second position;

at least one adjusting device including a first adjustable engagement element and a second adjustable engagement element;

the first engagement element comprising a pin that interacts with a first guide arranged on the camshaft and the second engagement element comprising a pin that interacts with a second guide arranged on the camshaft, the first engagement element and the second engagement element being alternately adjustable between a basic position and a switching position;

wherein, in the basic position, the first engagement element does not contact the first guide and, in the switching position, the first engagement element interacts with the first guide;

wherein, in the basic position, the second engagement element does not contact the second guide and, in the switching position, the second engagement element interacts with the second guide;

at least one control shaft including at least one control cam group, the at least one control cam group including a first control cam fixed on the at least one control shaft and a second control cam fixed on the at least one control shaft; and wherein the at least one control shaft is rotatably mounted about a longitudinal axis, the first control cam includes at least one idle region and at least one stop region corresponding to the first engagement element, the second control cam includes at least one idle region and at least one stop region corresponding to the second engagement element, and wherein when the at least one control shaft is rotated, the at least one stop region of the first control cam adjusts the first engagement element from the basic position into the switching position and the at least one stop region of the second control cam adjusts the second engagement element from the basic position into the switching position in succession.

2. The valve drive according to claim 1, wherein the at least one control shaft is mounted such that the at least one control shaft is rotatable into an activation direction and into a deactivation direction opposite the activation direction, and wherein a rotation of the at least one control shaft in the activation direction adjusts the first engagement element from the basic position into the switching position via the first control cam and a rotation of the at least one control shaft in the deactivation direction adjusts the second engagement element from the basic position into the switching position via the second control cam.

3. The valve drive according to claim 1, wherein the at least one control shaft includes a plurality of control cam groups, and wherein a control cam group of the plurality of control cam groups actuates the at least one adjusting device such that a cam profile is adjustable adjusts between at least two different cam profiles.

4. The valve drive according to claim 1, wherein the at least one control shaft includes at least two control shafts each including at least one control cam group, and wherein the at least one control cam group actuates the at least one adjusting device such that a cam profile adjusts between at least two different cam profiles.

5. The valve drive according to claim 1, wherein the at least one control shaft includes an inner shaft and an outer shaft encasing the inner shaft, the inner shaft and the outer shaft rotatable relative to one another, and wherein the first control cam is arranged on one of the inner shaft and the outer shaft and the second control cam is arranged on one of the outer shaft and the inner shaft.

6. The valve drive according to claim 1, wherein at least one of i) the at least one stop region of the first control cam and ii) the at least one stop region of the second control cam extends from the longitudinal axis of the at least one control shaft radially to an outside.

7. The valve drive according to claim 6, wherein at least one of i) the at least one stop region of the first control cam and ii) the at least one stop region of the second control cam includes an opening angle between 0° and 270° relative to the longitudinal axis of the at least one control shaft.

8. The valve drive according to claim 1, wherein the at least one adjusting device includes a plurality of adjusting devices and the at least one cam follower includes a plurality of cam followers, and wherein the at least one stop region of the first control cam and the at least one stop region of the second control cam are arranged on the at least one control shaft turned relative to one another by an arrangement angle such that the plurality of adjusting devices and the plurality of cam followers actuate at least one of in succession, individually, and in pairs such that at least a plurality of second valve strokes are switched at least one of in succession, individually, and in pairs.

9. The valve drive according to claim 1, wherein at least one of i) the at least one stop region of the first control cam and ii) the at least one stop region of the second control cam includes a ramp region.

10. The valve drive according to claim 9, wherein an area of the ramp region of at least one of the first control cam and the second control cam increases from a neutral region to the at least one stop region of the at least one of the first control cam and the second control cam.

11. The valve drive according to claim 1, further comprising a control shaft drive.

12. The valve drive according to claim 1, wherein the at least one control shaft includes a spring resetting arrangement configured to adjust the at least one control shaft into a starting position.

13. The valve drive according to claim 12, wherein the spring resetting arrangement includes at least one of a torsion spring, a helical spring, and a flexible spring.

14. The valve drive according to claim 1, wherein the second control cam is a zero stroke cam configured to deactivate a corresponding cylinder.

15. The valve drive according to claim 1, wherein the second control cam is a braking cam configured as an exhaust brake.

16. The valve drive according to claim 1, wherein the second control cam is a braking cam including two stop regions configured as a two-stroke exhaust brake.

17. The valve drive according to claim 1, wherein at least one of i) the at least one stop region of the first control cam and ii) the at least one stop region of the second control cam is a profiled recess in the at least one control shaft.

18. The valve drive according to claim 1, wherein the first guide and the second guide are arranged on one of i) a slotted guide of the camshaft and ii) a first slotted guide of the camshaft and a second slotted guide of the camshaft, respectively.

19. The valve drive according to claim 1, wherein the first engagement element and the second engagement element are structured and arranged to extend radially relative to the camshaft.

20. An internal combustion engine comprising the valve drive of claim 1.

* * * * *